US005253489A

United States Patent [19]

Yoshii

[11] Patent Number: 5,253,489

[45] Date of Patent: Oct. 19, 1993

[54] SCROLL TYPE COMPRESSOR WITH INJECTION MECHANISM

[75] Inventor: Yuji Yoshii, Isesaki, Japan

[73] Assignee: Sanden Corporation, Gunma, Japan

[21] Appl. No.: 862,511

[22] Filed: Apr. 2, 1992

[30] Foreign Application Priority Data

Apr. 2, 1991 [JP] Japan ..... 3-021148[U]

[51] Int. Cl.[5] ..... F04C 18/04; F04C 29/02

[52] U.S. Cl. ..... 62/505; 418/55.2; 418/55.6; 418/97

[58] Field of Search ..... 62/505; 418/55.1, 55.2, 418/55.6, 97, 15

[56] References Cited

U.S. PATENT DOCUMENTS

| | | | |
|---|---|---|---|
| 4,432,708 | 2/1984 | Hiraga et al. | 418/55.1 |
| 4,505,651 | 3/1985 | Terauchi et al. | 417/440 |
| 4,642,034 | 2/1987 | Terauchi | 417/295 |
| 4,875,840 | 10/1989 | Johnson et al. | 418/55.6 |
| 4,913,635 | 4/1990 | Ochiai et al. | 418/55.1 |
| 4,940,395 | 7/1990 | Yamamoto et al. | 417/310 |

FOREIGN PATENT DOCUMENTS

| | | | |
|---|---|---|---|
| 61-192890 | 8/1986 | Japan | 418/55.1 |

*Primary Examiner*—John J. Vrablik

*Attorney, Agent, or Firm*—Baker & Botts

[57] ABSTRACT

The present invention is directed to a scroll type compressor having an injection mechanism in which a part of the refrigerant flowing from the condenser is combined with the refrigerant in the intermediately located fluid pockets of the scroll elements in order to increase the amount of heat radiation from the refrigerant in the condenser without increasing the capacity of the compressor and in order to prevent operation of the compressor at a thermally severe condition. The injection mechanism includes a horseshoe-shaped groove formed between a circular end plate of a fixed scroll and an end portion of a casing adjacent to the circular end plate, a pair of axial conduits formed through the end plate of the fixed scroll and an axial hole formed through the end portion of the casing. The refrigerant is conducted to the intermediately located fluid pockets of the scroll elements via the axial hole, the groove and the axial conduits which are connected in series for fluid communication. In accordance with the present invention, the injection mechanism is easily assembled, and the thermal influence of the high temperature discharged refrigerant gas in the discharge chamber of the injection mechanism is negligible so that the operation of the compressor at a thermally severe condition is effectively prevented.

34 Claims, 12 Drawing Sheets

SCROLL TYPE COMPRESSOR WITH INJECTION MECHANISM

BACKGROUND OF THE INVENTION

1. Field of the Invention

The present invention relates to a scroll type compressor, and more particularly, to a scroll type compressor having an injection mechanism through which a portion of the refrigerant flowing from the condenser is introduced into the intermediately compressed refrigerant in the compressor.

2. Description of the Prior Art

As known in this technical field, a refrigeration circuit includes a compressor, a condenser, an expansion device and an evaporator all connected in series.

In operation of the refrigeration circuit, the vaporized refrigerant conducted into the compressor from the evaporator is compressed, and is then discharged to the condenser. The refrigerant in the condenser is liquefied by radiating heat therefrom. The liquefied refrigerant in the condenser is then conducted to the expansion device, and is expanded due to the reduction in pressure as the liquefied refrigerant flows therethrough. The expanded refrigerant further flows into the evaporator, and is vaporized due to the absorption of heat. The vaporized refrigerant in the evaporator is returned to the compressor so that the above processes can then be repeated.

A modified refrigeration circuit in which a condenser is used for heating purposes is discussed in Issued Japanese Patent No. 64-10675. Referring to FIG. 1, the modified refrigeration circuit includes motor driven hermetic type scroll compressor 1, condenser 2, first expansion device 3, liquid-vapor separator 4 from which the liquefied refrigerant and the gaseous refrigerant flow out through first and second outlets 4*a* and 4*b* thereof, respectively, second expansion device 5 and evaporator 6. An outlet of compressor 1 is connected to an inlet of condenser 2, which in turn has an outlet connected to an inlet of first expansion device 3. An outlet of first expansion device 3 is connected to an inlet of separator 4 and a first outlet 4*a* of separator 4 is connected to an inlet of second expansion device 5. An outlet of second expansion device 5 is connected to an inlet of evaporator 6, the outlet of which is connected to an inlet of compressor 1, so as to complete the refrigeration circuit.

The modified refrigeration circuit further includes a pipe member 7 which fluidly connects second outlet 4*b* of liquid-vapor separator 4 with the intermediately located sealed-off fluid pockets of the scroll compressor. The pressure in the intermediately located sealed-off fluid pockets is lower than the pressure in second outlet 4*b* of separator 4. A valve element such as electromagnetic valve 8 is also provided at pipe member 7 so as to selectively communicate the intermediately located sealed-off fluid pockets with second outlet 4*b* of separator 4. In FIG. 1, arrow "A" indicates the refrigerant flow in the modified refrigeration circuit.

In operation of the modified refrigeration circuit, the gaseous refrigerant which flows from separator 4 through second outlet 4*b* is conducted into the intermediately located sealed-off fluid pockets of the scroll elements through pipe member 7 so as to be combined with the gaseous refrigerant which was taken into the outermost fluid pockets of the scroll elements from the evaporator and then continuously compressed. The combined gaseous refrigerant in the intermediately located sealed-off fluid pockets is further compressed, and is then discharged to condenser 2. Accordingly, the amount of gaseous refrigerant flowing into condenser 2 from compressor 1 is increased without increasing the capacity of compressor 1, and thus, the amount of heat radiation from the refrigerant in condenser 2 is likewise increased without increasing the capacity of compressor 1.

The above-described refrigeration method, that is, combining vaporized refrigerant flowing from the condenser and through the liquid-vapor separator with the intermediately compressed refrigerant in the compressor is generally called "gas injection". Therefore, the method is simply described as "gas injection" hereinafter for convenience.

The above-mentioned '675 Japanese patent discloses a motor driven hermetic type scroll compressor utilized in the modified refrigeration circuit shown in FIG. 1. Referring also to FIG. 2, motor driven hermetic type scroll compressor 100' includes hermetically sealed casing 110 which comprises cylindrical portion 111 and a pair of plate-shaped portions 112*a* and 112*b* which are hermetically connected to an upper end and a lower end of cylindrical portion 111, respectively, by brazing, for example.

Casing 110 houses fixed scroll 10, orbiting scroll 20, block member 30, driving mechanism 50 and a rotation-preventing mechanism, such as Oldham coupling 60. Fixed scroll 10 includes circular end plate 11 from which spiral element 12 extends. Orbiting scroll 20 includes circular end plate 21 from which spiral element 22 extends. Block member 30 is firmly secured to an upper inner peripheral wall of cylindrical portion 111.

Circular end plate 11 is attached by a plurality of fastening members, such as bolts (not shown), to block member 30 in order to define chamber 40 in which orbiting scroll 20 is disposed. Spiral elements 12 and 22 are interfitted at an angular and a radial offset to produce a plurality of linear contacts defining at least one pair of sealed-off fluid pockets. Driving mechanism 50, which includes rotatably supported drive shaft 51, is connected to orbiting scroll 20 to effect the orbital motion of orbiting scroll 20. Oldham coupling 60 is disposed between circular end plate 21 and block member 30 to prevent the rotation of orbiting scroll 20 during its orbital motion.

Circular end plate 21 of orbiting scroll 20 divides chamber 40 into first chamber 41 in which spiral elements 12 and 22 are disposed and second chamber 42 in which Oldham coupling 60 and crank pin 52 of driving mechanism 50 are disposed. Discharge port 70 is formed at a central portion of circular end plate 11 to discharge the compressed fluid from a central fluid pocket.

Drive shaft 51 is rotatably supported in a bore 31 that is centrally formed in block member 30. First and second plain bearings 52*a* and 52*b* are axially spaced from each other by a given distance and are disposed between an inner peripheral surface of bore 31 and an outer peripheral surface of drive shaft 51.

Casing 110 further houses motor 53 for rotating drive shaft 51. Motor 53 includes ring-shaped stator 53*a* and ring-shaped rotor 53*b*. Stator 53*a* is firmly secured to the inner peripheral wall of cylindrical portion 111 and rotor 53*b* is firmly secured to drive shaft 51. An axial hole (not shown) is formed in drive shaft 51 to supply lubricating oil 55 collected in the bottom of casing 110 to a gap between the outer peripheral surface of drive shaft 51 and an inner peripheral surface of bearings 52*a* and 52*b*.

In order to supply suction fluid to the outermost fluid pockets, one end of radial inlet port 83 is hermetically sealed to cylindrical portion 111 and is connected to suction port 80 formed in a peripheral portion of circular end plate 11. The other end of radial inlet port 83 is connected to the outlet of evaporator 6. One end of radial outlet port 73 is also hermetically sealed to cylindrical portion 111 in order to establish fluid communication with the inner space 101 of casing 110. The other end of radial outlet port 73 is connected to the inlet of condenser 2.

One end of pipe member 7 is connected to second outlet 4*b* of liquid-vapor separator 4. The other end of pipe member 7 is hermetically sealed to upper plate-shaped portion 112*a* and is connected to one end of pipe member 91. Pipe member 91 is disposed within inner space 101 of casing 110 above fixed scroll 10. Pipe member 91 is forked into portions 91*a* and 91*b* which are connected to a pair of axial holes 13 formed through circular end plate 11 of fixed scroll 10. Each axial hole 13 includes a large diameter portion 13*a* and a small diameter portion 13*b* extending downwardly from a lower end thereof. Holes 13 link portions 91*a* and 91*b* of pipe member 91 to a pair of intermediately located sealed-off fluid pockets 92, in which the pressure is lower than the pressure in second outlet 4*b* of separator 4. Pipe members 7 and 91 and axial holes 13 thereby form gas injection mechanism 90'.

In operation, suction gas entering suction port 80 from evaporator 6 flows through inlet port 83 into the outermost fluid pockets of the scroll elements, and is then compressed by virtue of the orbital motion of orbiting scroll 20. The gaseous refrigerant which flows from liquid-vapor separator 4 through second outlet 4*b* is introduced into the intermediately located sealed-off fluid pockets 92 of the scroll elements via pipe members 7 and 91 and axial holes 13 so as to be combined with the gaseous refrigerant which was taken into the outermost fluid pockets 92 of the scroll elements and continuously compressed. The combined gaseous refrigerant in intermediately located sealed-off fluid pockets 92 is further compressed, and is discharged from the centrally located sealed-off fluid pocket through discharge port 70. The discharged refrigerant gas thereby fills the entirety of inner space 101 of casing 100, except for chamber 40. The discharged refrigerant gas within inner space 101 of casing 100 flows to condenser 2 through outlet port 73.

In the above-described '675 Japanese patent, gas injection mechanism 90' includes a plurality of connecting portions, such as, the connecting portion between pipe member 91 and pipe member 7, and the connecting portions between holes 13 and forked portions 91*a* and 91*b* of pipe member 91. Therefore, when compressor 100' is assembled, a complicated process is required for assembling gas injection mechanism 90'. This causes an increase in the manufacturing cost of the compressor.

Another modified refrigeration circuit illustrated in FIG. 1*a* is discussed in Japanese Patent Application Publication No. 60-166778. The same numerals are used in FIG. 1*a* to denote the corresponding elements shown in FIG. 1, and an explanation thereof is omitted. In the embodiment of FIG. 1*a*, the modified refrigeration circuit includes pipe member 7 having one end connected for fluid communication with the refrigerant flowing between condenser 2 and expansion device 5, and further including an additional expansion device 9 provided along pipe member 7. The other end of pipe member 7 is connected to the scroll compressor intermediately located sealed-off fluid pockets in which the pressure is lower than the pressure in the portion of pipe member 7 located on the downstream side of additional expansion device 9.

In operation of this modified refrigeration circuit, a part of the liquefied refrigerant which flows from condenser 2 is diverged into pipe member 7, and flows through additional expansion device 9 thereby reducing the pressure thereof. The reduced pressure liquefied refrigerant is next introduced into the intermediately located sealed-off fluid pockets of the scroll elements through pipe member 7 to be combined with the gaseous refrigerant which was taken from the evaporator into the outermost fluid pockets of the scroll elements and was continuously compressed. At this stage, the scroll elements and the gaseous refrigerant in the intermediately located sealed-off fluid pockets of the scroll elements are cooled by vaporization of the reduced pressure liquefied refrigerant from condenser 2. The combined gaseous refrigerant at the intermediately located sealed-off fluid pockets is further continuously compressed, and is then discharged to condenser 2. Accordingly, the operation of the compressor at a thermally severe condition can be prevented and the overheating thereof can thus be avoided. The above-described refrigeration method, that is, introducing the reduced pressure liquefied refrigerant from the condenser through the additional expansion valve to the intermediately compressed refrigerant in the compressor is generally called "liquid injection". Therefore, for convenience, this method is simply referred to as "liquid injection" hereinafter. For further convenience, "gas injection" and "liquid injection" are generally described as "injection" hereinafter.

If motor driven hermetic type scroll compressor 100' of FIG. 2 is utilized in the modified refrigeration circuit of FIG. 1*a*, the thermal influence of the discharged high temperature refrigerant gas in inner space 101 of casing 100 on pipe member 91, which is exposed to the discharged refrigerant gas in inner space 101 of casing 100, is not negligible because the mass of pipe member 91 is small, and therefore, the thermal capacity of pipe member 91 is correspondingly small. Hence, a large part of the reduced pressure liquefied refrigerant from condenser 2 passing through additional expansion device 9 is vaporized in pipe member 91. Accordingly, the scroll elements and the gaseous refrigerant in intermediately located sealed-off fluid pockets 92 of the scroll elements may not be effectively cooled and compressor 100' may ultimately operate at a thermally severe condition.

SUMMARY OF THE INVENTION

Accordingly, it is an object of the present invention to provide a scroll type compressor having an easily assembled injection mechanism.

It is another object of the present invention to provide a scroll type compressor having an injection mechanism for which the thermal influence of the discharged high temperature refrigerant gas is negligible.

These and other objects of the invention are provided for by a scroll type compressor including a housing, a fixed scroll having a first circular end plate from which a first spiral element extends, and an orbiting scroll having a second circular end plate from which a second spiral element extends. The first spiral element and the second spiral element interfit at an angular and radial offset to form a plurality of linear contacts defining at least one pair of sealed-off fluid pockets. A driving mechanism effects the orbital motion of the orbiting scroll and a rotation preventing mechanism prevents the rotation of the orbiting scroll during its orbital motion such that the volume of the fluid pockets change. The housing includes an end portion which faces the first circular end plate of the fixed scroll. The scroll compressor forms a part of a refrigeration circuit including a condenser. A fluid communication mechanism links a downstream side of the condenser to at least one sealed-off fluid pocket having a pressure lower than the pressure at the downstream side of the condenser. The communication mechanism includes a communication path formed in the end portion of the housing and the first end plate of the fixed scroll. An inner surface of the end portion of the housing fits in close contact with an end surface of the first end plate of the fixed scroll that is opposite to the first spiral element.

DETAILED DESCRIPTION OF THE PREFERRED EMBODIMENTS

Figure 2:
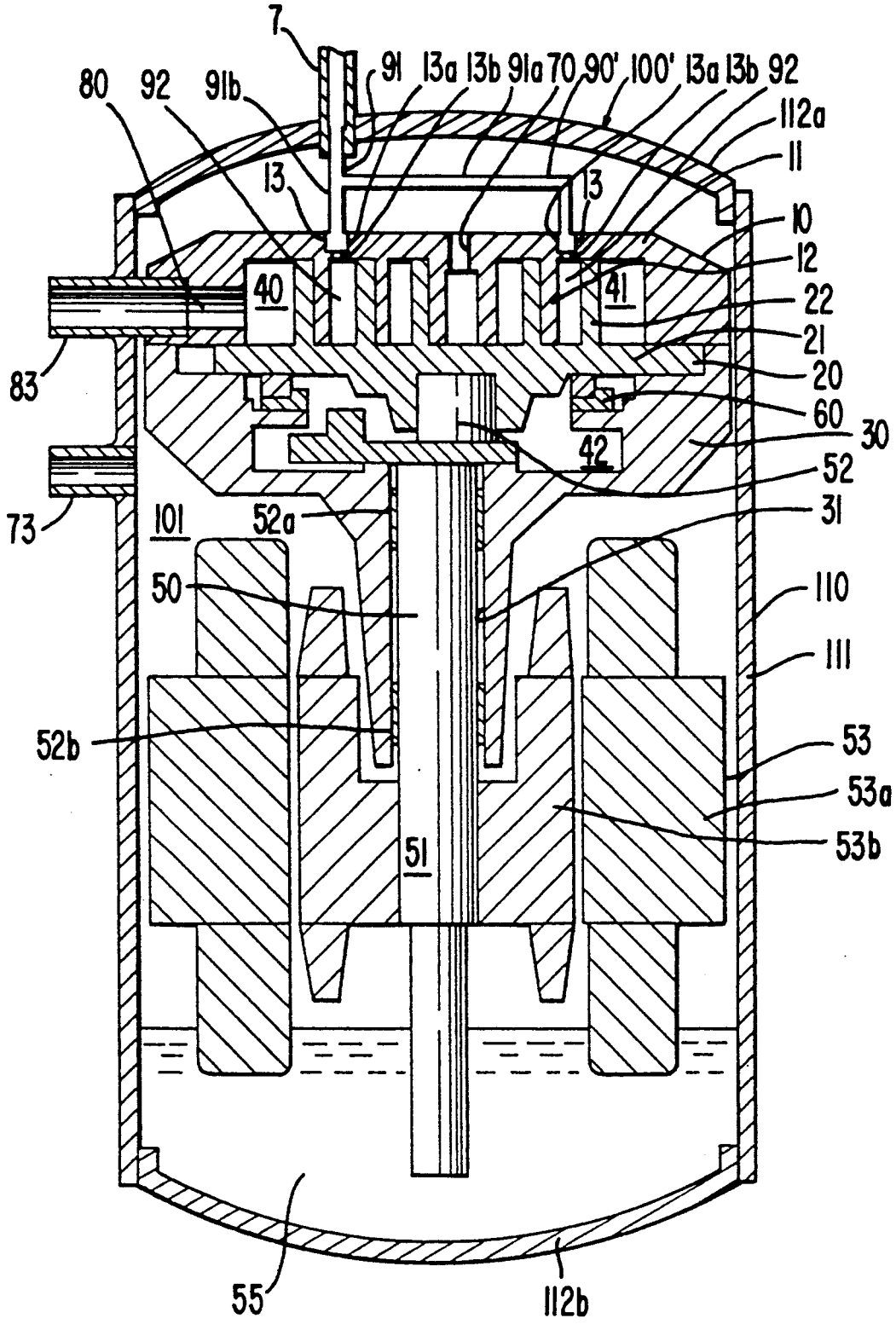
FIG. 2 (PRIOR ART)
FIG. 2 is a longitudinal sectional view of a motor driven hermetic type scroll compressor in accordance with a prior art embodiment.

FIGS. 3, 5, 6 and 8 illustrate longitudinal sectional views of the motor driven hermatic type scroll compressors in accordance with the first through fourth embodiments of the present invention, respectively. The same numerals are used in FIGS. 3, 5, 6 and 8 to denote the corresponding elements shown in FIG. 2, and a detailed explanation thereof is therefore omitted.

Figure 9:
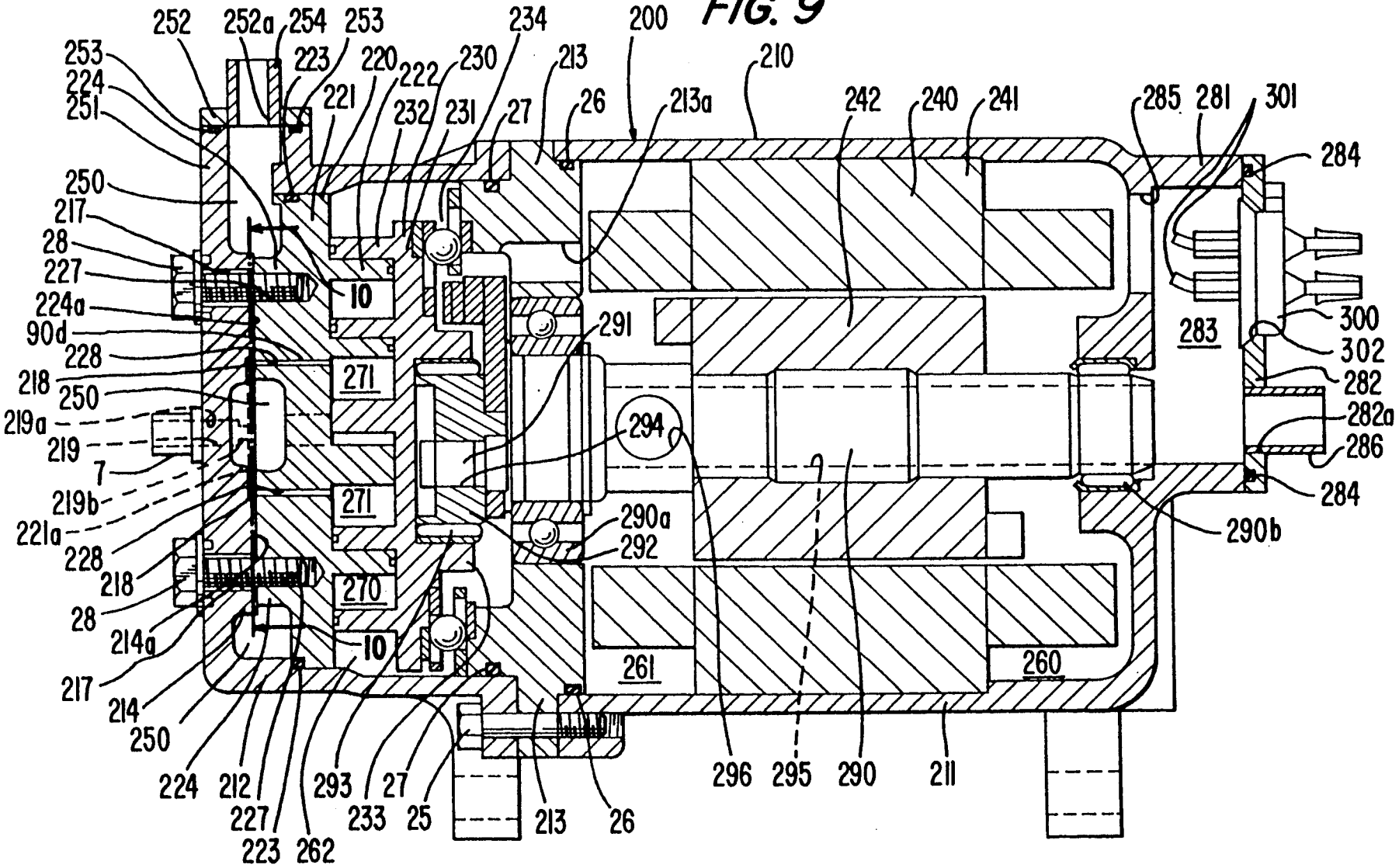
FIG. 9 is a longitudinal sectional view of a motor driven hermetic type scroll compressor in accordance with a fifth embodiment of the present invention.
Figure 11:
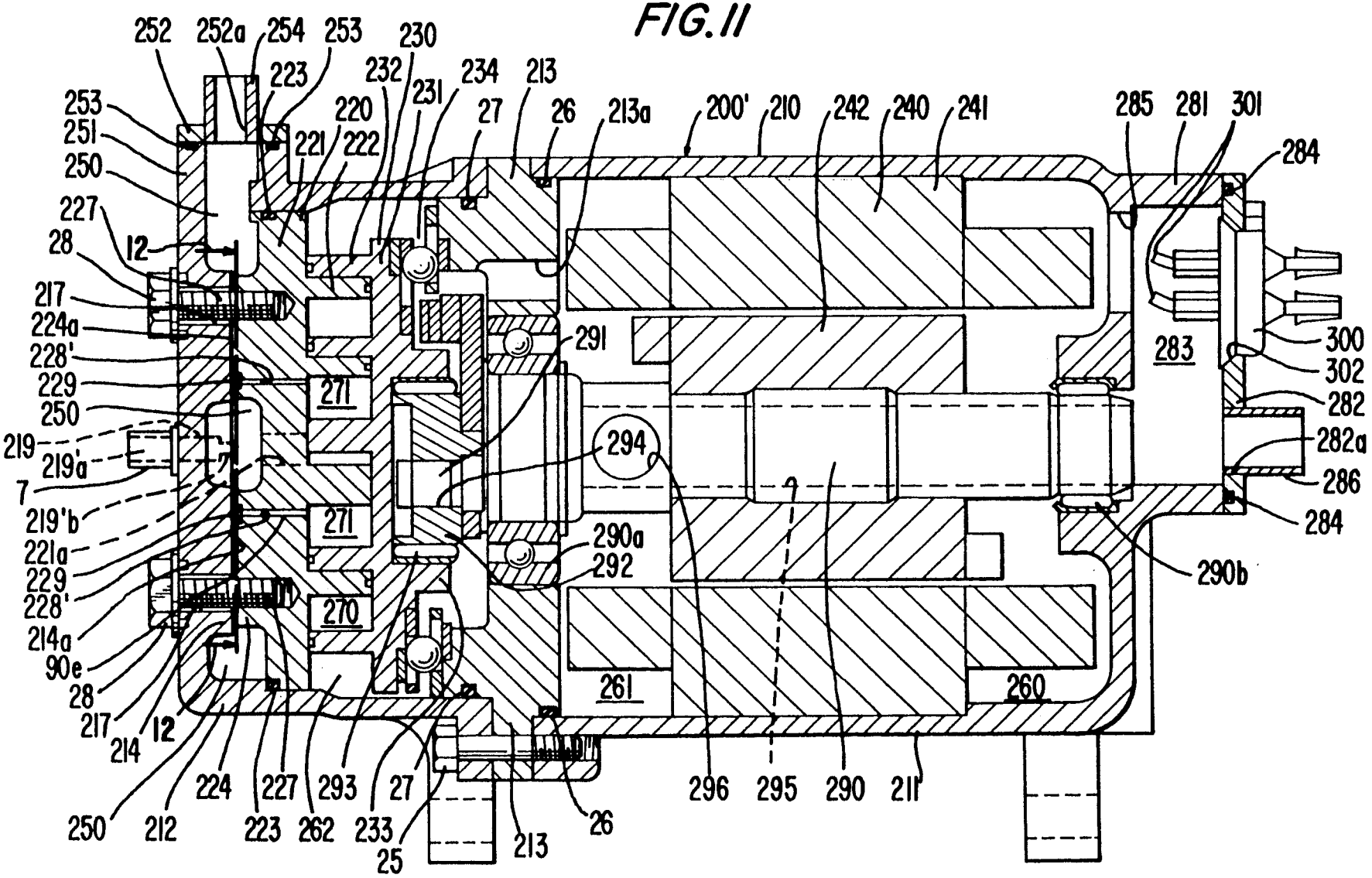
FIG. 11 is a longitudinal sectional view of a motor driven hermetic type scroll compressor in accordance with a sixth embodiment of the present invention.
Figure 13:
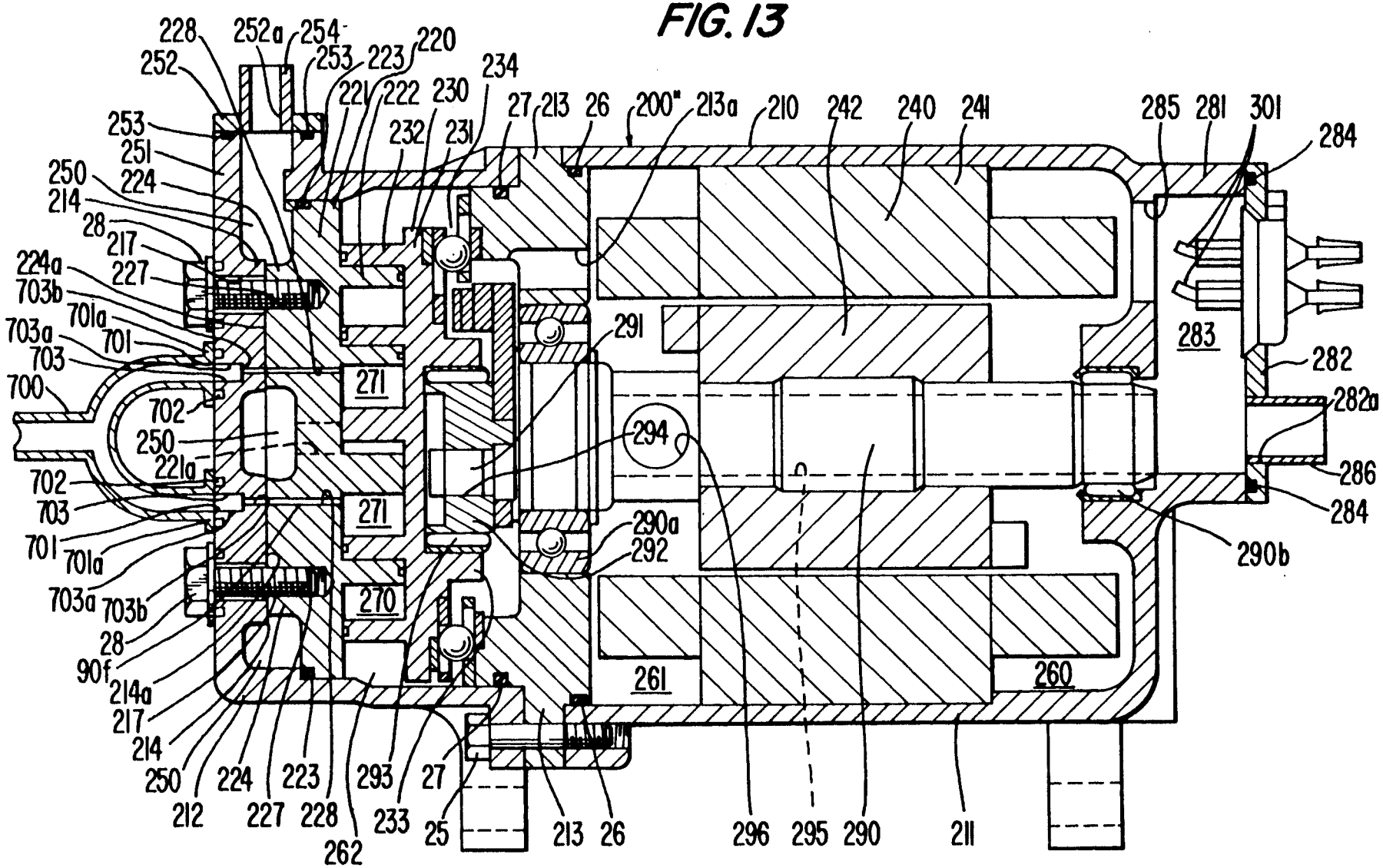
FIG. 13 is a longitudinal sectional view of a motor driven hermetic type scroll compressor in accordance with a seventh embodiment of the present invention.

FIGS. 9, 11 and 13 illustrate longitudinal sectional views of the motor driven hermetic type scroll compressors in accordance with the fifth through seventh embodiments of the present invention, respectively. The same numerals are used in FIGS. 11 and 13 to denote the corresponding elements shown in FIG. 9, and a detailed explanation thereof is therefore omitted.

Furthermore, the operation of the motor driven hermetic type scroll compressor in accordance with each of the second through fourth embodiments of the present invention is similar to the operation of the first embodiment of the present invention so that a detailed explanation thereof is likewise omitted. The operation of the motor driven hermetic type scroll compressor in accordance with each of the sixth and seventh embodiments of the present invention is similar to the operation of the fifth embodiment of the present invention so that an explanation thereof will also be omitted.

Figure 1:
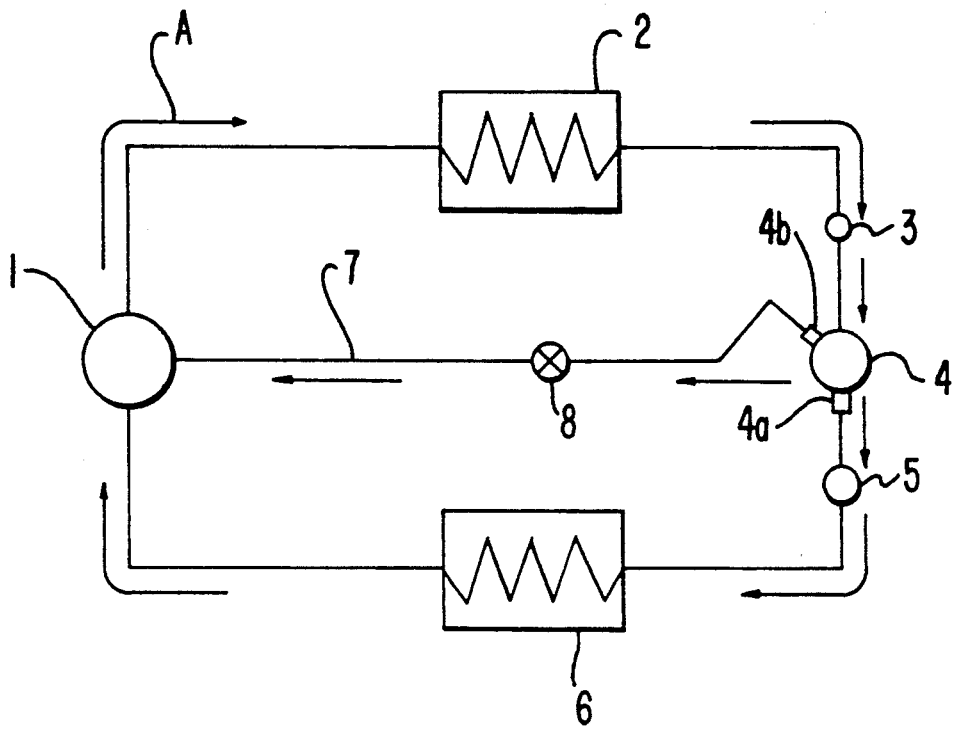
FIG. 1 is a block diagram of a modified refrigeration circuit in which a part of the refrigerant flowing from a condenser is recompressed in a compressor.

Still furthermore, for convenience, all of the embodiments of the present invention are described relative to the compressors being utilized in the modified refrigeration circuit of FIG. 1, that is, each of the embodiments of the present invention is directed to a compressor having a gas injection mechanism.

Figure 3:
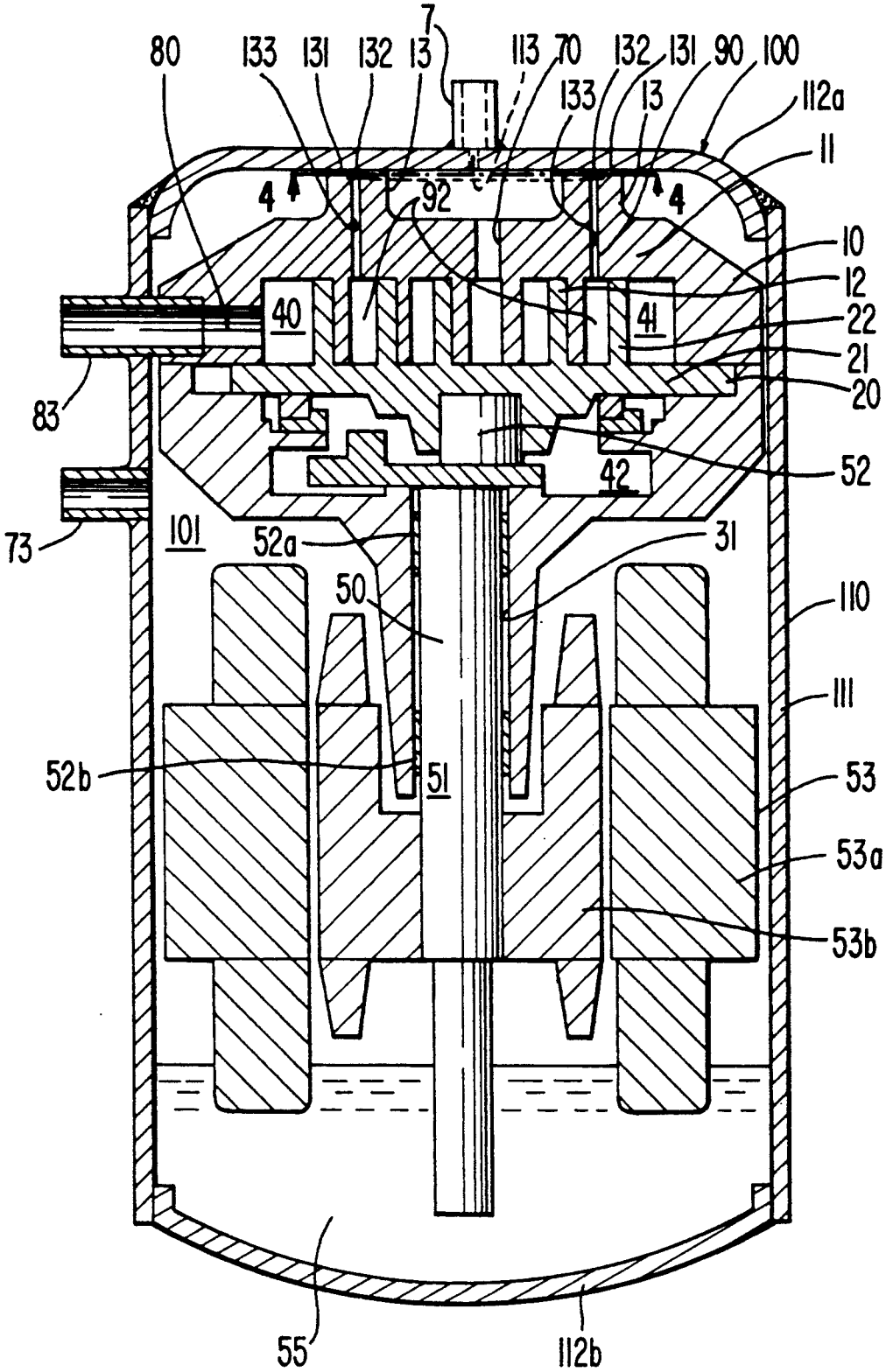
FIG. 3 is a longitudinal sectional view of a motor driven hermetic type scroll compressor in accordance with a first embodiment of the present invention.
Figure 4:
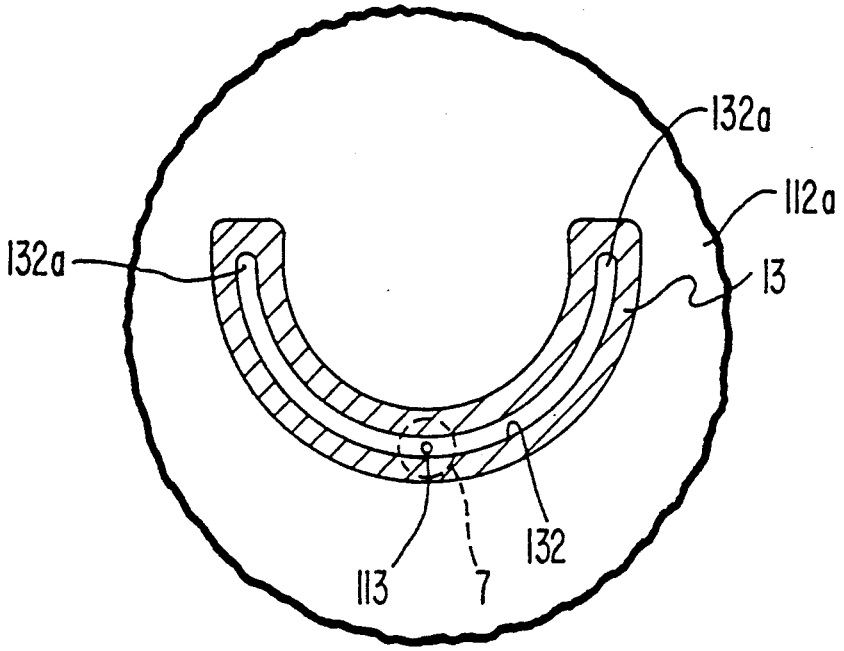
FIG. 4 is a cross sectional view taken along line 4—4 of FIG. 3.

Referring to FIGS. 3 and 4, in the first embodiment of the present invention horseshoe-shaped projection 13 is formed on an upper end surface of circular end plate 11 of fixed scroll 10 opposite to spiral element 12. Horseshoe-shaped projection 13 includes flat terminal end surface 131. Groove 132 having a rectangular cross-section is formed in flat terminal end surface 131 of projection 13 and extends along flat terminal end surface 131 of projection 13. A pair of axial conduits 133 are formed through circular end plate 11 so as to link the pair of intermediately located sealed-off fluid pockets 92 with the terminal ends 132*a* of groove 132. Axial hole 113 is formed through upper plate-shaped portion 112*a* so as to link the interior of pipe member 7 with a central region of groove 132. Pipe member 7, axial hole 113, groove 132 and axial conduits 133 thereby form gas injection mechanism 90.

Gas injection mechanism 90 is manufactured as follows. Plate-shaped portions 112*a* and 112*b* are made from steel, for example, and are formed by press working. In the formation of plate-shaped portion 112*a*, if the inner surface of the end region of upper plate-shaped portion 112*a* is to be made smooth, the process of cutting the inner surface of the end region of upper plate-shaped portion 112*a* can be omitted. Horseshoe-shaped projection 13 is integrally formed with fixed scroll 10 by casting. Flat terminal end surface 131 of projection 13 is formed into a smooth surface by cutting in order to fit in close contact with the smooth inner surface of the end region of upper plate-shaped portion 112*a*. Conduits 133 are bored by, for example, drilling. Groove 132 can be formed during the casting process of fixed scroll 10, or alternatively, groove 132 can be formed by milling. In the assembling process of the compressor, upper plate-shaped portion 112*a* is placed on horseshoe-shaped projection 13 to establish a close contact fit between the smooth flat terminal end surface 131 of projection 13 and the smooth inner surface of the end region of upper plate-shaped portion 112*a*. Upper plate-shaped portion 112*a* and the upper end of cylindrical casing 111 are then hermetically connected by, for example, brazing. Accordingly, leakage of the refrigerant through the mating surfaces of the end region of upper plate-shaped portion 112*a* and horseshoe-shaped projection 13 can be prevented.

Referring to FIGS. 1, 3 and 4, in operation of the compressor in accordance with the first embodiment of the present invention, suction gas entering suction port 80 from evaporator 6 flows through inlet port 83 into the outermost sealed-off fluid pockets of the scroll elements, and is then compressed by virtue of the orbital motion of orbiting scroll 20. The gaseous refrigerant which flows from liquid-vapor separator 4 through second outlet 4*b* is introduced into the intermediately located sealed-off fluid pockets 92 of the scroll elements via pipe member 7, axial hole 113, groove 132 and axial conduits 133 so as to be combined with the gaseous refrigerant which was taken into the outer-most sealed-off fluid pockets of the scroll elements and continuously compressed. The combined gaseous refrigerant at the intermediately located sealed-off fluid pockets 92 of the scroll elements is further continuously compressed, and is discharged from the centrally located sealed-off fluid pocket through discharge port 70. The discharged refrigerant gas fills the entirety of inner space 101 of casing 100, with the exception of chamber 40. The discharged refrigerant gas from inner space 101 of casing 100 then flows to condenser 2 through outlet port 73.

Figure 5:
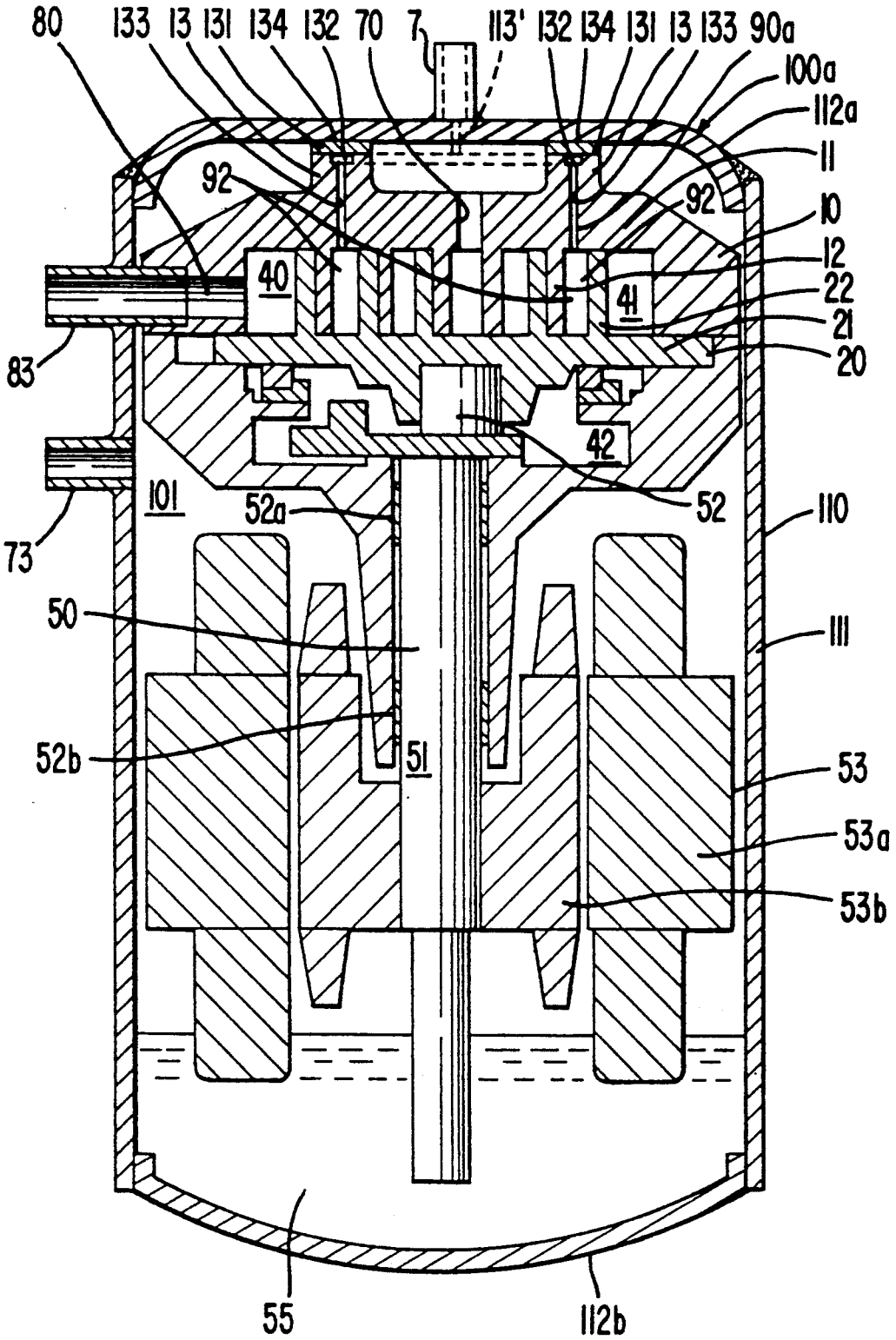
FIG. 5 is a longitudinal sectional view of a motor driven hermetic type scroll compressor in accordance with a second embodiment of the present invention.

Referring to FIG. 5, in the second embodiment of the present invention, horseshoe-shaped gasket 134, for which a plan view is essentially congruous with the cross sectional view of horseshoe-shaped projection 13, is sandwiched between flat terminal end surface 131 of projection 13 and the inner surface of the end region of upper plate-shaped portion 112*a* so that the leakage of the refrigerant through the mating surfaces of the end region of upper plate-shaped portion 112*a* and horseshoe-shaped projection 13 is more effectively prevented. Axial hole 113' is formed through the end region of upper plate-shaped portion 112*a* and gasket 134 so as to link the interior of pipe member 7 with the central region of groove 132. Pipe member 7, axial hole 113', groove 132 and axial conduits 133 thus for gas injection mechanism 90*a*.

Figure 7:
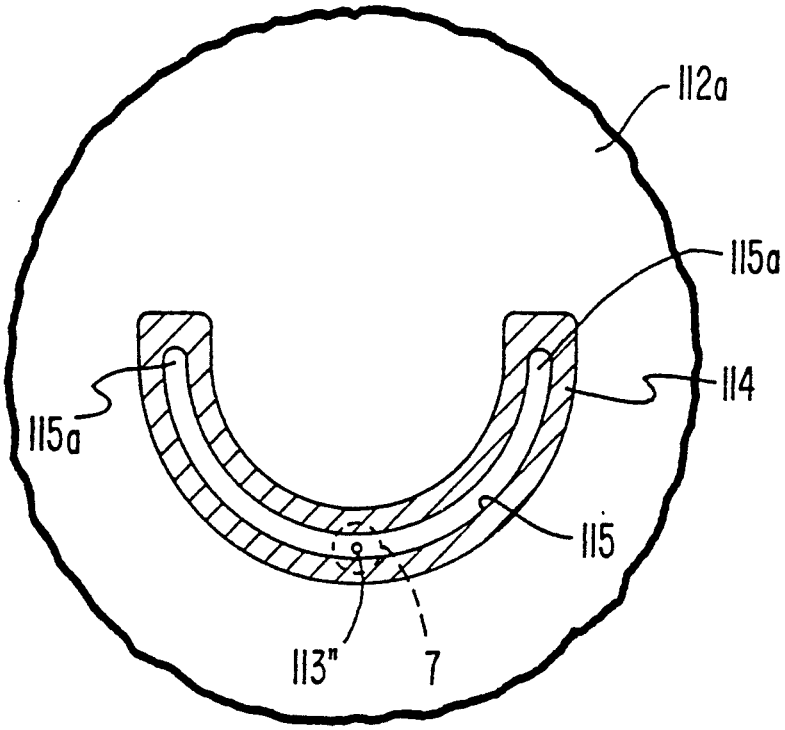
FIG. 7 is a cross sectional view taken along line 7—7 of FIG. 6.
Figure 6:
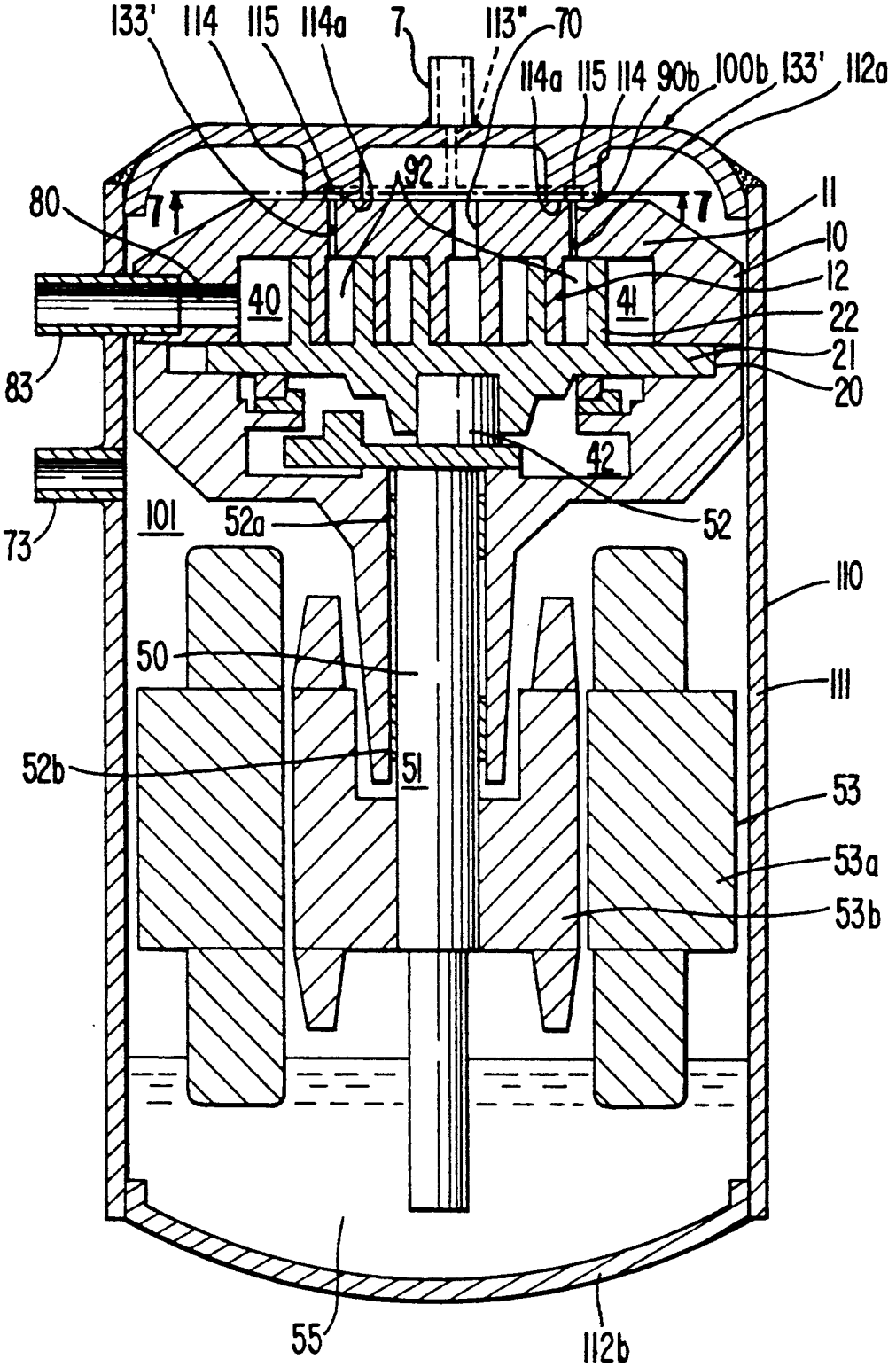
FIG. 6 is a longitudinal sectional view of a motor driven hermetic type scroll compressor in accordance with a third embodiment of the present invention.

Referring to FIGS. 6 and 7, in the third embodiment of the present invention horseshoe-shaped projection 114 is formed on the inner surface of the end region of upper plate-shaped portion 112*a*. Horseshoe-shaped projection 114 includes flat terminal end surface 114*a*. Referring additionally to FIG. 7, groove 115 having a rectangular cross sectional is formed in flat terminal end surface 114*a* of projection 114 and extends along flat terminal end surface 114*a* of projection 114. A pair of axial conduits 133' are formed through circular end plate 11 of fixed scroll 10 so as to link the pair of intermediately located sealed-off fluid pockets 92 with the terminal ends 115*a* of groove 115. Axial hole 113" is formed through projection 114 so as to link the interior of pipe member 7 with the central region of groove 115. Pipe member 7, axial hole 113", groove 115 and axial conduits 133' form gas injection mechanism 90*b*.

In the assembling process of the compressor, upper plate-shaped portion 112*a* is placed on circular end plate 11 of fixed scroll 10 to establish a close contact fit between the smooth flat terminal end surface 114*a* of horseshoe-shaped projection 114 and the smooth upper end surface of circular end plate 11 of fixed scroll 10. The opening end of upper plate-shaped portion 112*a* and the upper end of cylindrical casing 111 are then hermetically connected by brazing, for example. Accordingly, leakage of the refrigerant through the mating surfaces of horseshoe-shaped projection 114 and circular end plate 11 of fixed scroll 10 can be prevented.

Figure 8:
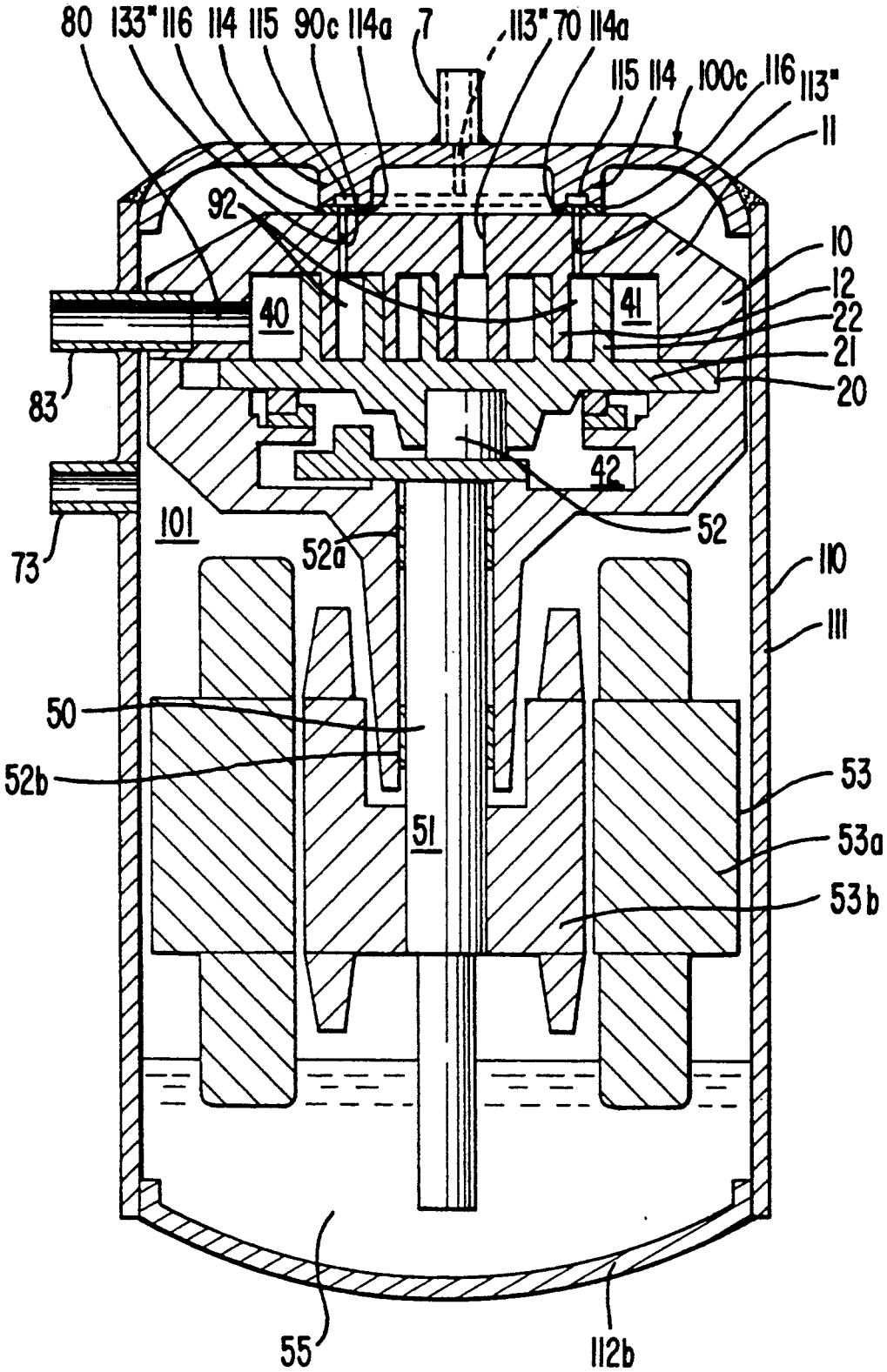
FIG. 8 is a longitudinal sectional view of a motor driven hermetic type scroll compressor in accordance with a fourth embodiment of the present invention.

Referring to FIG. 8, in the fourth embodiment of the present invention, horseshoe-shaped gasket 116, for which a plan view is essentially congruous with the cross sectional view of horseshoe-shaped projection 114, is sandwiched between flat terminal end surface 114*a* of projection 114 and the upper end surface of circular end plate 11 of fixed scroll 10 so that leakage of the refrigerant through the mating surfaces of horseshoe-shaped projection 114 and circular end plate 11 of fixed scroll 10 is more effectively prevented. A pair of axial conduits 133" are formed through gasket 116 and circular end plate 11 of fixed scroll so as to link the pair of intermediately located sealed-off fluid pockets 92 with the terminal ends 115*a* of groove 115. Pipe member 7, axial hole 113", groove 115 and axial conduits 133" form gas injection mechanism 90*c*.

FIG. 9 illustrates a motor driven hermetic type scroll compressor in accordance with a fifth embodiment of the present invention. For purposes of explanation only, the left side of the figure will be referenced as the forward end or front and the right side of the figure will be referenced as the rearward end.

Compressor 200 includes hermetically sealed casing 210, fixed and orbiting scrolls 220, 230 and motor 240. Compressor casing 210 includes first cup-shaped casing 211 and second cup-shaped casing 212 which is located at the front of first cup-shaped casing 211. The openings of first and second cup-shaped casings 211, 212 are fixedly connected to each other by a plurality of bolts 25 through an outer peripheral portion of circular block member 213. O-ring seal 26 is disposed between an inner peripheral surface of the open end portion of first cup-shaped casing 211 and an outer peripheral surface of circular block member 213 to seal the mating surfaces of first cup-shaped casing 211 and circular block member 213. O-ring seal 27 is disposed between an inner peripheral surface of the open end portion of second cup-shaped casing 212 and the outer peripheral surface of circular block member 213. Fixed scroll 220 includes circular end plate 221 and spiral element or wrap 222 extending from one end (rearward) surface thereof. Fixed scroll 220 is fixedly disposed within a front end portion of second cup-shaped casing 212 by a plurality of screws 28. Circular end plate 221 of fixed scroll 220 partitions an inner chamber of casing 210 into two chambers, for example, discharge chamber 250 and suction chamber 260. O-ring seal 223 is disposed between the inner peripheral surface of second cup-shaped casing 212 and the outer peripheral surface of circular end plate 221 in order to seal the mating surfaces of second cup-shaped casing 212 and circular end plate 221. Circular block member 213 partitions suction chamber 260 into first suction chamber section 261 at the rear of block member 213 and second suction chamber section 262 at the front of block member 213. A plurality of holes 213*a* are axially formed through block member 213 to link first and second suction chamber sections 261 and 262, respectively.

Orbiting scroll 230 disposed within second suction chamber section 262 includes circular end plate 231 and spiral element or wrap 232 extending from one end (forward) surface of circular end plate 231. Spiral element 222 of fixed scroll 220 and spiral element 232 of orbiting scroll 230 interfit at an angular and radial offset to form a plurality of linear contacts which define at least one pair of sealed off fluid pockets 270. Discharge port 221*a* is formed at a central portion of circular end plate 221 to discharge the compressed fluid from a central sealed-off fluid pocket. Annular projection 233 is formed at the rearward end surface of circular end plate 231 opposite spiral element 232. Rotation prevention device 234 is disposed on the outer circumferential surface of annular projection 233 to prevent rotation of orbiting scroll 230 during its orbital motion.

Motor 240 includes ring-shaped stator 241 and ring-shaped rotor 242. Stator 241 is firmly secured to the inner peripheral wall of first cup-shaped casing 211 and rotor 242 is firmly secured to drive shaft 290. Drive shaft 290 axially penetrates the center of block member 213. A front end of drive shaft 290 is rotatably supported by block member 213 through bearing 290*a*. A rear end of drive shaft 290 is rotatably supported by a rear portion of first cup-shaped casing 211 through bearing 290*b*. Pin member 291 is integral with and axially projects from the forward end surface of drive shaft 290 and is radially offset from the axis of drive shaft 290. Bushing 292 is rotatably disposed within annular projection 233 and is supported by bearing 293. Pin member 291 is rotatably inserted in hole 294 of bushing 292, hole 294 being offset from the center of bushing 292.

Drive shaft 290 is provided with axial bore 295 extending from an opening at the rearward end of drive shaft 290, that is, the end opposite pin member 291, to the closed end rearward of bearing 290*a*. Radial bore 296 is located near the closed end in order to link axial bore 295 to first suction chamber section 261 between motor 40 and bearing 290*a*.

Annular cylindrical projection 281 is integral with and projects axially rearwardly from the rear end portion of first cup-shaped casing 211. Circular plate 282 is fixedly disposed on a rear end of annual cylindrical projection 281 by a plurality of bolts (not shown) so that chamber 283 is defined by annular cylindrical projection 281, circular plate 282 and the rear end portion of first cup-shaped casing 211. O-ring seal 284 is disposed between the rear end surface of annular cylindrical projection 281 and a front end surface of circular plate 282 to seal the mating surfaces of annular cylindrical projection 281 and circular plate 282. Hole 285 is formed through the rear end portion of first cup-shaped casing 211 so as to link first suction chamber section 261 to chamber 283. Wires 301 extend from stator 241 and pass through hermetic seal base 300 for connection with an electrical power source (not shown). Hermetic seal base 300 is hermetically secured to circular plate 282 about hole 302. For example, base 300 may be welded or brazed to circular plate 282 about hole 282*a* and faces the opening of axial bore 295. Suction gas inlet pipe 286 links chamber 283 to evaporator 6 of FIG. 1.

Discharge gas outlet port 251 is integral with and projects upwardly from a side wall of second cup-shaped casing 212. Circular plate 252 is fixedly disposed on an upper end of outlet port 251 by a plurality of bolts (not shown). O-ring seal 253 is disposed between a lower end surface of circular plate 252 and an upper surface of outlet port 251 to seal the mating surfaces of outlet port 51 and circular plate 252. Discharge gas outlet pipe 254 is fixedly and hermetically connected to circular plate 252 about hole 252*a* and links discharge chamber 250 to condenser 2 of FIG. 1.

Figure 10:
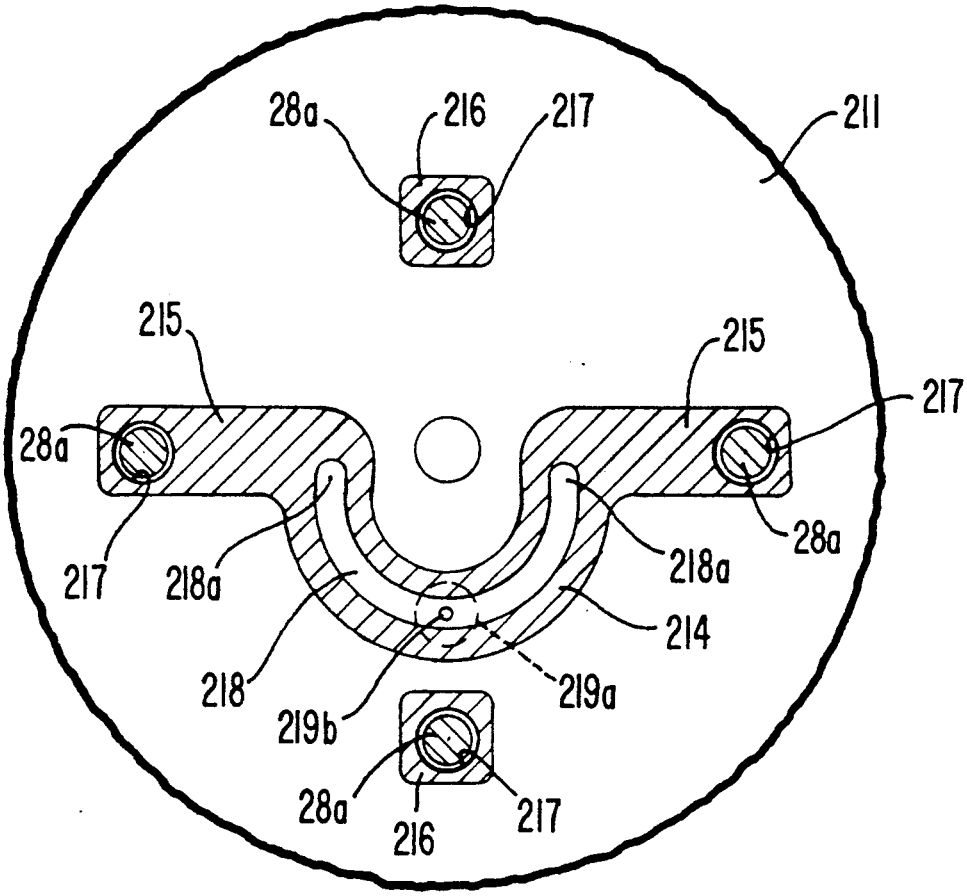
FIG. 10 is a cross sectional view taken along line 10—10 of FIG. 9.

Referring to FIG. 10 additionally, first horseshoe-shaped projection 214 is formed on an inner end surface of the end portion of second cup-shaped casing 212. A pair of straight sections 215 are integral with and radially extend in opposite directions from each respective end of first horseshoe-shaped projection 214. A pair of leg sections 216 are integral with and axially extend from the inner end surface of second cup-shaped casing 212. Leg sections 216 are located on a line intersecting first horseshoe-shaped projection 214 and are opposite with respect to first horseshoe-shaped projection 214. First horseshoe-shaped projection 214 includes rear end surface 214*a* which is coplanar with a rear end surface of each of the straight and leg sections 215 and 216. Rear end surface 214*a* of first horseshoe-shaped projection 214 is formed into a smooth surface by cutting. Identical holes 217 are formed through straight sections 215 and leg sections 216 for penetration of the shaft portion 28*a* of screws 28. Groove 218, having a rectangular cross sectional configuration, is formed in the rear end surface 214*a* of first horseshoe-shaped projection 214 and extends along the rear end surface 214*a* of projection 214.

Referring to FIGS. 9 and 10, second horseshoe-shaped projection 224 is formed on a front end surface of circular end plate 221 of fixed scroll 220 opposite to spiral element 222. A pair of straight sections 225 are integral with and radially extend in opposite directions from both ends of second horseshoe-shaped projection 224. A pair of leg sections 226 are integral with and axially extend from the front end surface of circular end plate 221 of fixed scroll 220. Leg sections 226 are located on a line intersecting second horseshoe-shaped projection 224 and are opposite with respect to second horseshoe-shaped projection 224. Second horseshoe-shaped projection 224 includes front end surface 224*a* which is coplanar with a front end surface of each of the straight and leg sections 225 and 226. Front end surface 224*a* of projection 224 is formed into a smooth surface by cutting in order to fit in contact with the smooth rear end surface 214*a* of first horseshoe-shaped projection 214. Identical female screw portions 227 are formed through the straight and leg sections 225, 226, respectively, for receiving the threaded shaft portions 28*b* of screws 28. A pair of axial conduits 228 are formed through circular end plate 221 of fixed scroll 220 to link the pair of intermediately located sealed-off fluid pockets 271 with the terminal ends 218*a* of groove 218. Axial hole 219, having a large diameter portion 219*a* and small diameter portion 219*b* extending from the rear thereof, is formed through first horseshoe-shaped projection 214 to link the interior of pipe member 7 with a central region of groove 218. Pipe member 7, axial hole 219, groove 218 and axial conduits 228 thereby form gas injections mechanism 90*d*.

A stable close fit contact between the smooth rear end surface 214*a* of first horseshoe-shaped projection 214 and the smooth front end surface 224*a* of second horseshoe-shaped projection 224 is maintained by screwing screws 28 into female screw portions 227.

Referring to FIGS. 1, 9 and 10, in operation of the compressor in accordance with the fifth embodiment of the present invention, the refrigerant gas entering chamber 283 from evaporator 6 through suction gas inlet pipe 286 is directly introduced into first suction chamber section 261 through hole 285, and is largely taken into axial bore 295. The refrigerant gas taken into axial bore 295 flows forward through axial bore 295, and then flows out from axial bore 295 through radial bore 296. The refrigerant gas flowing out from axial bore 295 joins the suction gas directly introduced into first suction chamber section 261. The combined refrigerant gas in first suction chamber section 261 then flows into second suction chamber section 262 through holes 213*a* formed through block member 213, flows further forward in second suction chamber section 262 through rotation prevention device 234, and is then taken into the outermost sealed-off fluid pockets of the scroll elements. The refrigerant gas taken into the outermost sealed-off fluid pockets is compressed by virtue of the orbital motion of orbiting scroll 230. The gaseous refrigerant which flows from liquid-vapor separator 4 through second outlet 4*b* is introduced into the intermediately located sealed-off fluid pockets 271 of the scroll elements, via pipe member 7, axial hole 219, groove 218 and axial conduits 228, to be combined with the gaseous refrigerant which was taken into the outermost sealed-off fluid pockets of the scroll elements and continuously compressed therein. The combined gaseous refrigerant at the intermediately located sealed-off fluid pockets 271 of the scroll elements is also continuously compressed and is discharged from the centrally located sealed-off fluid pocket through discharge port 221*a* into discharge chamber 250. The discharged refrigerant gas in discharge chamber 250 flows to condenser 2 through discharge gas outlet pipe 254.

Figure 12:
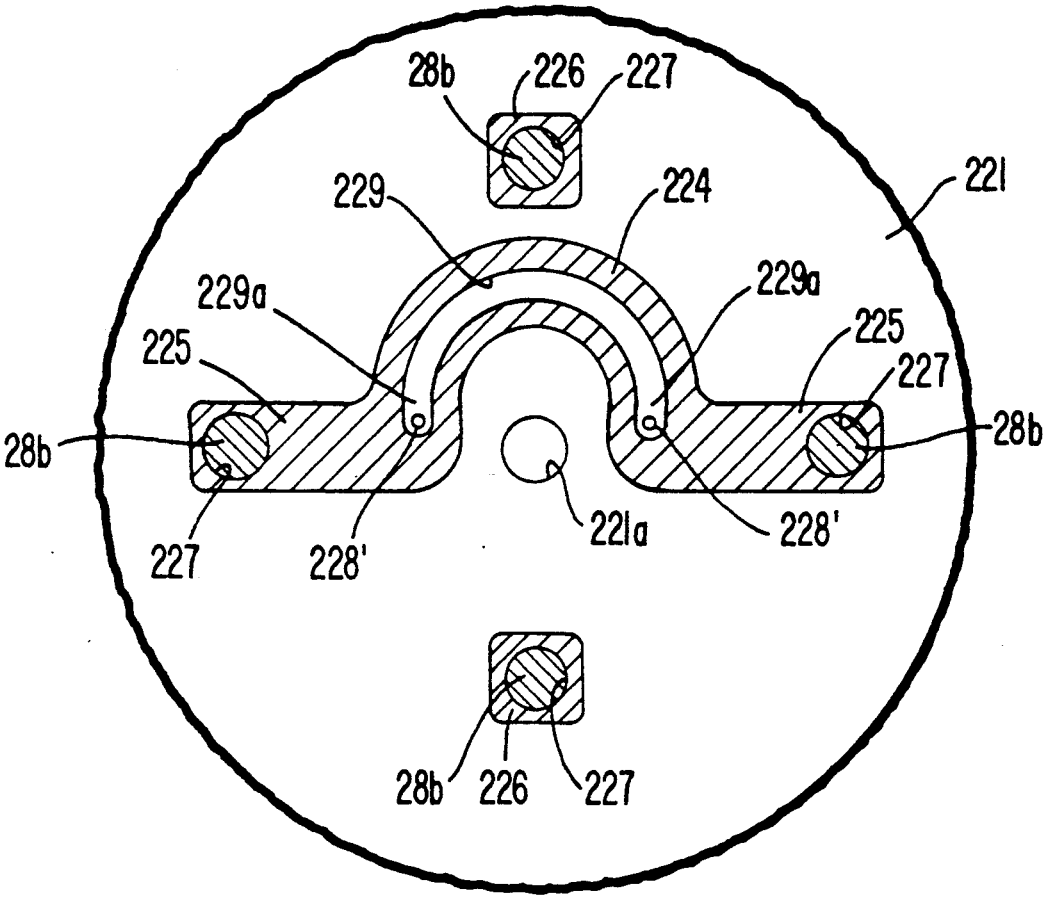
FIG. 12 is a cross sectional view taken along line 12—12 of FIG. 11.

Referring to FIGS. 11 and 12, in the sixth embodiment of the present invention, groove 229, having a rectangular cross section, is formed in the front end surface 221*a* of second horseshoe-shaped projection 224 and extends along front end surface 224*a* of projection 224. A pair of axial conduits 228' are formed through circular end plate 221 of fixed scroll 220 to link the pair of intermediately located sealed-off fluid pockets 271 with the terminal ends 229*a* of groove 229. Axial hole 219', having a large diameter portion 219'*a* and a small diameter portion 219'*b* extending therefrom, is formed through first horseshoe-shaped projection 214 to link the interior of pipe member 7 with a central region of groove 229. Pipe member 7, axial hole 219', groove 229 and axial conduits 228' thus form gas injection mechanism 90*e*.

Referring to FIG. 13, compressor 200'' includes pipe member 700 connected at one end to an end of pipe member 7 of FIG. 1. The other end of pipe member 700 is formed as a U-shaped fork having a pair of open ends 701. Each open end 701 includes flange portion 701*a*. The pair of open ends 701 of pipe member 700 are fixedly connected to a central region of the outer surface of the end portion of second cup-shaped casing 212 by screws (not shown). O-ring seal 702 is disposed between the rear end surface of flange portion 701*a* and the outer surface of the end portion of second cup-shaped casing 212 to seal the mating surfaces of flange portion 701*a* and the end portion of second cup-shaped casing 212. A pair of axial holes 703 are formed through first horseshoe-shaped projection 214. Each axial hole 703 includes a large diameter portion 703*a* and a small diameter portion 703*b* extending from the rear thereof. Axial holes 703 link open ends 701 to axial conduits 228 formed through circular end plate 221 of fixed scroll 220. Accordingly, intermediately located sealed-off fluid pockets 271 are linked in fluid communication to the interior of pipe member 7 of FIG. 1 through axial conduits 228, axial holes 703 and pipe member 700. Pipe members 7 and 700, axial holes 703 and axial conduits 228 thus form gas injection mechanism 90*f*.

As described above, the present invention provides for a compressor having an easily assembled injection mechanism such that the manufacturing cost of the compressor can be effectively reduced.

Figure 1A:
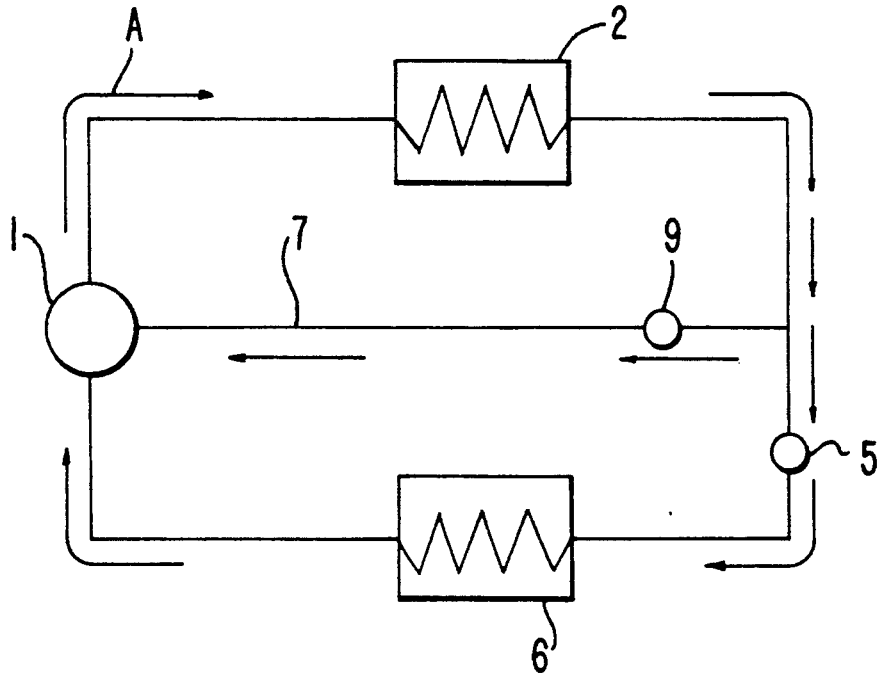
FIG. 1*a* is a block diagram of another modified refrigeration circuit in which a part of the refrigerant flowing from a condenser is recompressed in a compressor.

Furthermore, in the present invention, when the compressor having the injection mechanism is utilized with the aforementioned modified refrigeration circuit of FIG. 1*a*, the thermal influence of the high temperature discharged refrigerant gas to the discharge chamber of the injection mechanism is negligible because, since the mass of the injection mechanism is sufficiently large, the thermal capacity of the injection mechanism is likewise sufficiently large. Hence, a large part of the reduced pressure liquefied refrigerant flowing from the condenser through the additional expansion device is vaporized in the intermediately located sealed-off fluid pockets of the scroll elements. Accordingly, the scroll elements and the gaseous refrigerant in the intermediately located sealed-off fluid pockets of the scroll elements are effectively cooled. Therefore, operation of the compressor at a severe thermal condition is effectively prevented and overheating thereof is avoided.

Although illustrative embodiments have been described in detail with reference to the accompanying drawings, it is to be understood that the invention is not limited to those precise embodiments. Various changes and modifications may be effected therein by one skilled in the art without departing from the scope or spirit of the invention.

I claim:

1. In a scroll type compressor including a housing, a fixed scroll having a first end plate from which a first spiral element extends, an orbiting scroll having a second end plate from which a second spiral element extends, said first spiral element and said second spiral element interfitting at an angular and radial offset to form a plurality of linear contacts defining at least one pair of sealed-off fluid pockets, a driving mechanism to effect the orbital motion of said orbiting scroll, and a rotation-preventing mechanism for preventing the rotation of said orbiting scroll during its orbital motion such that the volume of said fluid pocket changes, said housing including an end portion which faces said first end plate of said fixed scroll, said scroll type compressor forming a part of a refrigeration circuit which includes a condenser, and communicating means for connecting in fluid communication a downstream side of said condenser and at least one of said sealed-off fluid pockets having a pressure therein that is lower than the pressure at the downstream side of said condenser, the improvement comprising:

said communicating means including a communication path formed through said end portion of said housing and said first end plate of said fixed scroll, and an inner surface of said end portion of said housing being fit in contact with one end surface of said first end plate of said fixed scroll that is opposite to said first spiral element at least for the distance of said communication path.

2. The scroll type compressor of claim 1 wherein said end portion of said housing is fixedly secured to said first end plate of said fixed scroll by at least one fastening means.

3. The scroll type compressor of claim 2 wherein said at least one fastening means comprises a bolt.

4. The scroll type compressor of claim 1 wherein said inner surface of said end portion of said housing and said one end surface of said first end plate of said fixed scroll comprise smooth flat surfaces.

5. The scroll type compressor of claim 1 wherein said communication path includes a groove formed between said inner surface of said end portion of said housing and said one end surface of said first end plate of said fixed scroll, at least one conduit formed through said end portion of said housing so as to link said groove with the downstream side of said condenser, and at least one conduit formed through said first end plate of said fixed scroll so as to link said groove with said at least one sealed-off fluid pocket.

6. The scroll type compressor of claim 1 wherein a sealing element is sandwiched between said inner surface of said end portion of said housing and said one end surface of said first end plate of said fixed scroll.

7. The scroll type compressor of claim 6 wherein said sealing element is a gasket.

8. The scroll type compressor of claim 1 wherein said first end plate of said fixed scroll includes a first projection projecting from said one end surface thereof and wherein said communication path passes through said first projection.

9. The scroll type compressor of claim 8 wherein said communication path includes a groove formed in an end surface of said first projection.

10. The scroll type compressor of claim 9 wherein said first projection is has a horseshoe-shaped configuration.

11. The scroll type compressor of claim 10 wherein said groove extends along said end surface of said horseshoe-shaped first projection.

12. The scroll type compressor of claim 1 wherein said end portion of said housing includes a projection projecting from said inner surface thereof and wherein said communication path passes through said projection.

13. The scroll type compressor of claim 12 wherein said communication path includes a groove formed in an end surface of said projection.

14. The scroll type compressor of claim 13 wherein said projection has a horseshoe-shaped configuration.

15. The scroll type compressor of claim 14 wherein said groove extends along said end surface of said horseshoe-shaped projection.

16. The scroll type compressor of claim 1 wherein said first end plate of said fixed scroll includes a first projection projecting from said one end surface thereof and said end portion of said housing includes a second projection projecting from said inner surface thereof, and wherein said communication path passes through said first projection and said second projection.

17. The scroll type compressor of claim 16 wherein said communication path includes a groove formed in an end surface of said first projection.

18. The scroll type compressor of claim 17 wherein said first projection has a horseshoe-shaped configuration.

19. The scroll type compressor of claim 18 wherein said groove extends along said end surface of said first projection.

20. The scroll type compressor of 16 wherein said communication path includes a groove formed in an end surface of said second projection.

21. The scroll type compressor of claim 20 wherein said second projection has a horseshoe-shaped configuration.

22. The scroll type compressor of claim 21 wherein said groove extends along said end surface of said second projection.

23. The scroll type compressor of claim 1 wherein said communication path includes a pipe member in fluid communication with the downstream side of said condenser and having a divided terminal portion with at least one open end connected to an outer surface of said end portion of said housing, at least one conduit formed through said end portion of said housing and said first end plate of said fixed scroll so as to link said at least one open end of said pipe member with said at least one sealed-off fluid pocket.

24. A scroll type fluid displacement apparatus comprising:

a housing having a front end plate;

a fixed scroll attached to said housing and having a first end plate from which a first wrap extends into an interior of said housing;

an orbiting scroll having a second end plate from which a second wrap extends, said first and second wraps interfitting at an angular and radial offset to form a plurality of linear contacts defining at least one pair of sealed-off fluid pockets;

a driving mechanism including a rotatable drive shaft connected to said orbiting scroll to drive said orbiting scroll in orbital motion;

a rotation preventing mechanism connected to said orbiting scroll for preventing the rotation of said orbiting scroll during orbital motion;

a fluid inlet connected to said front end plate of said housing;

an inner surface of said front end plate of said housing facing said first end plate of said fixed scroll and fitted in contact with an end surface of said first end plate that is opposite to an end surface from which said first wrap extends; and a fluid communication path formed through said front end plate of said housing and said first end plate of said fixed scroll where said front end plate of said housing and said first end plate of said fixed scroll are in fitted contact such that said fluid inlet and at least one of said sealed-off fluid pockets are joined in fluid communication.

25. The scroll type fluid displacement apparatus of claim 24 wherein said fluid communication path includes a groove formed between said inner surface of said front end plate of said housing and said one end surface of said first end plate of said fixed scroll, at least one conduit formed through said front end plate of said housing so as to link said groove with said inlet, and at least one conduit formed through said first end plate of said fixed scroll so as to link said groove to said at least one sealed-off fluid pocket.

26. The scroll type fluid displacement apparatus of claim 25 wherein a sealing element is disposed between said inner surface of said front plate of said housing and said one end surface of said first end plate of said fixed scroll.

27. The scroll type fluid displacement apparatus of claim 25 wherein said first end plate of said fixed scroll includes a first projection extending from said one end surface thereof and said groove is formed in an end surface of said first projection.

28. The scroll type fluid displacement apparatus of claim 25 wherein said front end plate of said housing includes a projection extending from said inner surface thereof and said groove is formed in an end surface of said projection.

29. The scroll type fluid displacement apparatus of claim 25 wherein said first end plate of said fixed scroll includes a first projection extending from said one end surface thereof and said front end plate of said housing includes a second projection extending from said inner surface thereof, and wherein said communication path passes through said first projection and said second projection.

30. The scroll type fluid displacement apparatus of claim 29 wherein said groove is formed in an end surface of said first projection.

31. The scroll type fluid displacement apparatus of claim 29 wherein said groove is formed in an end surface of said second projection.

32. The scroll type fluid displacement apparatus of claim 29 wherein at least one of said first projection and said second projection has a horseshoe-shaped configuration.

33. The scroll type fluid displacement apparatus of claim 24 wherein said fluid inlet includes a divided terminal portion with at least one open end connected to an outer surface of said front plate of said housing, and at least one conduit formed through said front plate of said housing and said first end plate of said fixed scroll so as to link said at least one open end of said fluid inlet with said at least one sealed-off fluid pocket.

34. The scroll type fluid displacement apparatus of claim 24 wherein said scroll type fluid displacement apparatus is utilized in a refrigeration circuit including a condenser such that said fluid displacement apparatus and said condenser form part of said refrigeration circuit;

said fluid inlet being connected to a downstream side of said condenser; and said fluid communication path joining the downstream side of said condenser and said at least one sealed-off fluid pocket in fluid communication.

* * * * *